US008563888B2

(12) United States Patent
Bohori et al.

(10) Patent No.: US 8,563,888 B2
(45) Date of Patent: Oct. 22, 2013

(54) ARC CONTAINMENT DEVICE AND METHOD

(75) Inventors: Adnan Kutubuddin Bohori, Bangalore (IN); Dean Arthur Robarge, Southington, CT (US); Robert Joseph Caggiano, Wolcott, CT (US); Thangavelu Asokan, Bangalore (IN); George William Roscoe, West Hartford, CT (US)

(73) Assignee: General Electric Company, Schenectady, NY (US)

( * ) Notice: Subject to any disclaimer, the term of this patent is extended or adjusted under 35 U.S.C. 154(b) by 760 days.

(21) Appl. No.: 12/137,460

(22) Filed: Jun. 11, 2008

(65) Prior Publication Data

US 2009/0308845 A1 Dec. 17, 2009

(51) Int. Cl.
*H01J 17/00* (2006.01)

(52) U.S. Cl.
USPC ..... 218/157; 218/147; 313/231.41

(58) Field of Classification Search
USPC ..... 218/15–21, 29, 34–40, 147–151, 156, 218/157; 335/201, 202; 313/231, 41
See application file for complete search history.

(56) References Cited

U.S. PATENT DOCUMENTS

| | | | |
|---|---|---|---|
| 3,575,680 | A | 4/1971 | Beaudoin et al. |
| 3,588,578 | A | 6/1971 | Clinkenbeard |
| 3,997,235 | A | 12/1976 | Boliver |
| 4,204,238 | A | 5/1980 | Stetson et al. |
| 4,259,704 | A | 3/1981 | Hamann |
| 4,289,941 | A | 9/1981 | Cannon |
| 4,347,414 | A | 8/1982 | Headley et al. |
| 4,369,364 | A | 1/1983 | Kuntermann |
| 4,409,447 | A | 10/1983 | Noeske |
| 4,431,946 | A | 2/1984 | O'Loughlin |
| 4,463,405 | A | 7/1984 | Koch et al. |
| 4,645,889 | A | 2/1987 | Howell |
| 5,231,242 | A | 7/1993 | Chryssomallis et al. |
| 5,363,266 | A | 11/1994 | Wiseman et al. |
| 5,402,100 | A | 3/1995 | Urbanek et al. |
| 5,650,902 | A | 7/1997 | Herkenrath |

(Continued)

FOREIGN PATENT DOCUMENTS

| | | | |
|---|---|---|---|
| CN | 1040110 | A | 2/1990 |
| DE | 3426054 | A1 | 12/1985 |

(Continued)

OTHER PUBLICATIONS

Search Report and Written Opinion from EP Application No. 09162315.7 dated Jul. 5, 2013.

(Continued)

*Primary Examiner* — Amy Cohen Johnson
*Assistant Examiner* — Marina Fishman
(74) *Attorney, Agent, or Firm* — Cantor Colburn LLP

(57) ABSTRACT

An arc containment device is presented. The arc containment device includes a shock shield further having a multiple apertures for escape of gas, the shock shield configured to surround an arc source. The device further comprises an inner enclosure having a multiple openings generally aligned with the multiple apertures, the inner enclosure configured to provide an electrical insulation base for the arc source. An outer enclosure disposed is provided around the inner enclosure, the outer enclosure configured to direct the gas to the environment outside the device.

21 Claims, 6 Drawing Sheets

(56) References Cited

U.S. PATENT DOCUMENTS

| | | | | |
|---|---|---|---|---|
| 5,905,244 | A | 5/1999 | Smith et al. | |
| 5,933,308 | A | 8/1999 | Garzon et al. | |
| 6,128,168 | A | 10/2000 | Arnold et al. | |
| 6,141,192 | A | 10/2000 | Garzon | |
| 6,177,368 | B1 | 1/2001 | Fisher | |
| 6,207,916 | B1 | 3/2001 | Pniok et al. | |
| 6,232,857 | B1 | 5/2001 | Mason, Jr. et al. | |
| 6,242,707 | B1 | 6/2001 | Mody et al. | |
| 6,291,788 | B1 | 9/2001 | Doughty et al. | |
| 6,417,671 | B1 | 7/2002 | Tiemann | |
| 6,433,976 | B1 | 8/2002 | Phillips | |
| 6,532,140 | B1 | 3/2003 | McMahon et al. | |
| 6,633,009 | B1 | 10/2003 | Shea | |
| 6,650,516 | B2 | 11/2003 | Langford et al. | |
| 6,657,150 | B1 | 12/2003 | Shea et al. | |
| 6,683,764 | B1 | 1/2004 | Pniok | |
| 6,751,528 | B1 | 6/2004 | Dougherty | |
| 6,839,209 | B2 | 1/2005 | Shea et al. | |
| 6,847,043 | B2 * | 1/2005 | Murrell et al. | 250/426 |
| 6,952,332 | B2 | 10/2005 | Slade et al. | |
| 6,977,354 | B1 * | 12/2005 | Shea et al. | 218/157 |
| 7,062,388 | B2 | 6/2006 | Rivers, Jr. et al. | |
| 7,705,263 | B2 * | 4/2010 | Rane et al. | 218/149 |
| 7,821,749 | B2 * | 10/2010 | Asokan et al. | 361/1 |
| 2003/0048586 | A1 * | 3/2003 | Faber et al. | 361/1 |
| 2003/0197129 | A1 | 10/2003 | Murrell et al. | |
| 2003/0231440 | A1 | 12/2003 | Papallo et al. | |
| 2003/0231443 | A1 | 12/2003 | Shea et al. | |
| 2003/0231453 | A1 | 12/2003 | Shea | |
| 2005/0063118 | A1 | 3/2005 | Durth et al. | |
| 2005/0152078 | A1 | 7/2005 | Shea et al. | |
| 2008/0239598 | A1 * | 10/2008 | Asokan et al. | 361/56 |

FOREIGN PATENT DOCUMENTS

| | | | | |
|---|---|---|---|---|
| DE | 4236623 | A1 | 5/1994 | |
| EP | 437151 | B1 * | 4/1995 | H01H 3/18 |
| EP | 0860918 | A1 | 8/1998 | |
| EP | 688071 | B1 | 8/1999 | |
| EP | 771057 | A1 | 9/2000 | |
| JP | 04255421 | A | 9/1992 | |
| JP | 04289721 | A | 10/1992 | |
| JP | 05003611 | A | 1/1993 | |
| JP | 7320576 | A | 12/1995 | |
| WO | 9522167 | A2 | 8/1995 | |
| WO | 9835237 | A2 | 8/1998 | |
| WO | 9921254 | A1 | 4/1999 | |
| WO | 9921255 | A1 | 4/1999 | |
| WO | 2005036709 | A1 | 4/2005 | |
| WO | 2006018530 | A1 | 2/2006 | |

OTHER PUBLICATIONS

Unofficial Translation of SIPO Office Action for CN Application No. 200910149170.5 dated Dec. 25, 2012.

Unofficial Translation of SIPO Search Report for CN Application No. 200910149170.5 dated Dec. 17, 2012.

Mesyats, Gennady A., Pulsed Power. Mesyats. Dec. 21, 2004.

Publication Titled: Bypass Gap, by GE Transmission, Distribution & Industrial Systems, regarding Series Compensation Systems, dated Nov. 14, 1999.

Search Report and Written Opinion from EP Application No. 08162440.5 dated Jul. 5, 2013.

Search Report and Written Opinion from EP Application No. 08153015.6 dated Jul. 5, 2013.

Keidar, Michael, et al., "Ablation study in the capillary discharge of an electrothermal gun", Journal of Applied Physics 99, Mar. 1, 2006 pp. 7-13.

Unofficial Translation of SIPO Search Report for CN Application No. 200810214269.4 dated Apr. 12, 2013.

* cited by examiner

ARC CONTAINMENT DEVICE AND METHOD

BACKGROUND

The invention relates generally to techniques for mitigating the effects of arcs, and more particularly to arc containment.

An arc flash may be defined as a condition associated with the release of energy caused by an electric arc. This release of energy is in the form of light and heat, often causing a pressure or shock wave. Arc flashes occur when the insulation between two conductors (often only air) can no longer withstand the voltage between them, resulting in an insulation breakdown. The energy produced by an arc flash event is a function of the voltage between the conductors, current flow during the event, and the duration of the event. To reduce or mitigate the deleterious effects of these events, design engineers have options such as grounding practices and current limiting fuses to reduce system voltage or fault currents. However, under certain conditions reducing arc fault clearing time is another approach to reducing the let-through energy resulting from the arc fault.

When arc flashes are contained, high energy levels released can involve very high pressure waves, on the order of tens to hundreds of bar, the transient and ultimate pressures of which depend upon the magnitude of short circuit current, and the volume and nature of a container. Consequently, the cost of the container increases exponentially with the magnitude of current. Shock waves are generated due to instantaneous heating of the gas or vaporized components around the arc. Pressures created by the shock wave may also be quite high, on the order of hundreds of bar, and are a function of the current magnitude and distance of the container wall from the arc. The shock waves occur during initial stages of arc formation. The ultimate pressure resulting from the expanding gas builds inside the container, and is generally a function of such factors as the duration of the event, the magnitude of the short circuit current and the volume of the containment chamber.

Therefore, there is a need for an arc containment approach designed to withstand both shock waves and high pressures with minimized size and cost.

BRIEF DESCRIPTION

According to an embodiment of the invention, an arc containment device is presented. The arc containment device includes a shock shield further having a plurality of apertures for escape of gas, the shock shield configured to surround an arc source. The device further comprises an inner enclosure having a plurality of openings generally aligned with the plurality of apertures, the inner enclosure configured to provide an electrical insulation base for the arc source. An outer enclosure is provided around the inner enclosure, the outer enclosure configured to direct the gas to the environment outside the device.

According to another embodiment, a method of manufacturing an arc containment device is presented. The method includes disposing a shock shield within an inner enclosure, the shock shield comprising a plurality of apertures generally aligned with openings in the inner enclosure. Further the method includes disposing an outer enclosure around the inner enclosure, the outer enclosure configured to provide a passageway for a gas between the inner enclosure and the outer enclosure. Further the method includes fixing an arc source on an electrical insulation base within the shock shield.

According to another embodiment, a method of containing an arc within an arc containment device is presented. The method includes containing a shock wave originating from an arc source by a shock shield, venting of gas via a plurality of apertures of the shock shield and a plurality of openings on an inner enclosure surrounding the shock shield and channeling the gas via the passageway between the inner enclosure and an outer enclosure.

According to another embodiment, an arc containment device is presented. The device includes a shock shield surrounding an arc source, the shock shield configured to contain a shock wave and an enclosure surrounding the shock shield, the enclosure configured to provide an electrical insulation base for the arc source.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
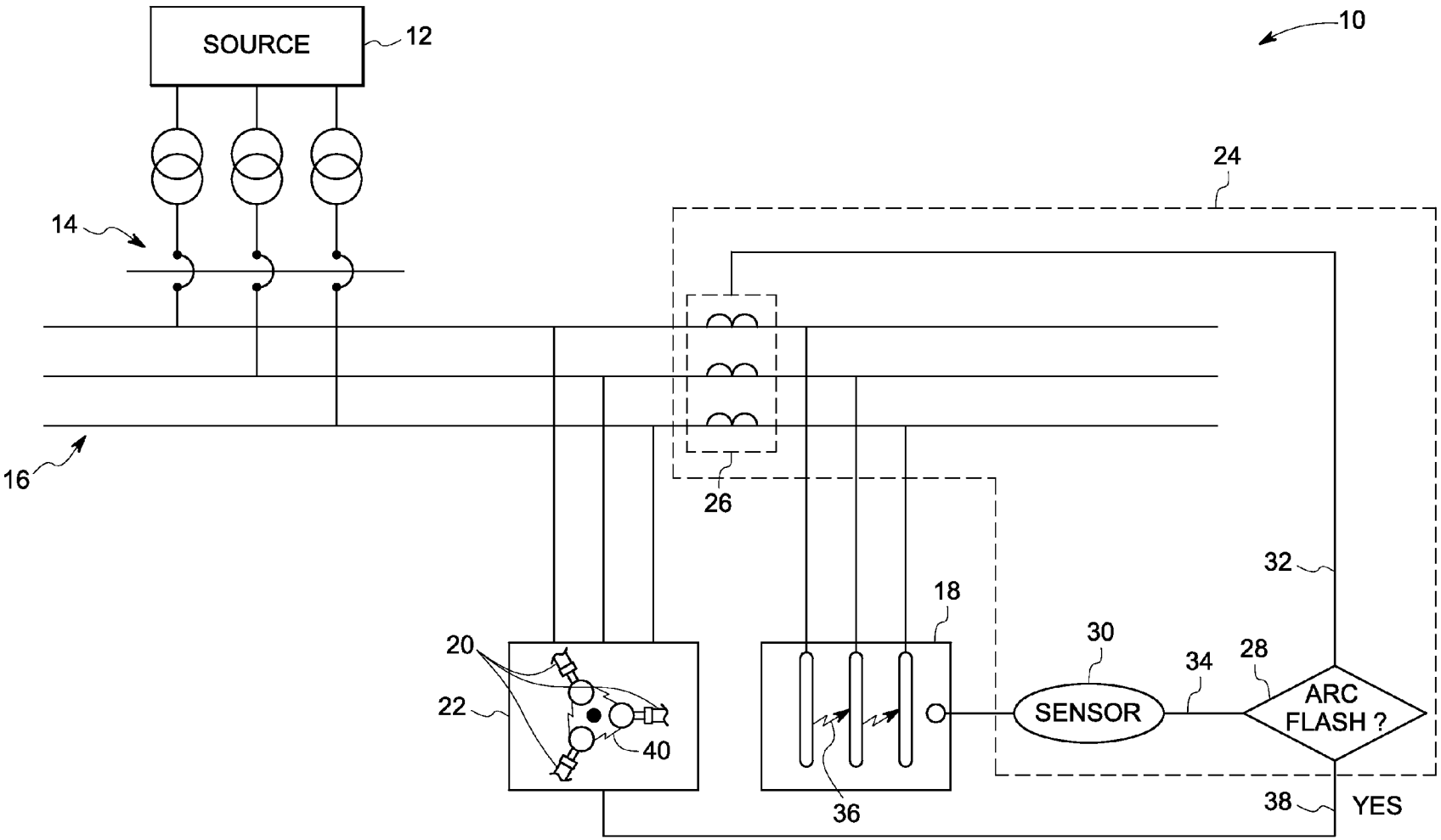
FIG. 1 is a schematic representation of an electrical system including an arc containment device.

Referring to FIG. 1, an electrical power system is illustrated and designated generally by the reference numeral 10. In the illustrated embodiment, the electrical power system 10 includes a power source 12 configured to deliver power to a load 18 via a circuit breaker 14. In an exemplary embodiment, the power source 12 is configured to deliver alternating current or AC power to the common bus 16. The electrical power system 10 illustrated herein includes a three phase configuration. In another embodiment, the electrical power system 10 may include a single phase configuration. The power source 12 and the load 18 are further coupled via a common bus 16 to an arc electrode system 20 (arc source). An example of the arc electrode system 20 includes but not limited to an arc crow bar device. The arc electrode system 20 is enclosed within an arc containment device 22.

An arc flash detection system 24 is configured to detect an arc flash event 36 within the electrical power system 10 and further includes an electrical signal monitoring system 26, arc flash decision system 28 and a sensor 30. The electrical signal monitoring system 26 is configured to monitor current variations in the electrical power system that may arise due to the arc flash event. In an example, the electrical signal monitoring system 26 includes a current transformer. Furthermore, the arc flash decision system 28 is configured to receive electrical parameters 32 from the electrical signal monitoring system 26 and parameters 34 from the sensor 30. As used herein, the term 'parameters' refers to parameters such as, for example, optical light, thermal radiation, acoustic, pressure, or radio frequency signal originating from an arc flash 36. Accordingly, in such an embodiment, the non-electrical sensor includes an optical sensor. Based on the parameters 32 and 34, the arc flash decision system 28 generates an arc fault signal 38 in an event of the arc flash event 36. The arc fault signal 38 further triggers the arc electrode system 20. As will be appreciated by those skilled in the art, the arc electrode system 20 helps mitigate effects of the arc flash event.

The arc electrode system 20 is configured to create an arcing fault that creates a second arc flash 40 within the arc containment device 22. The arc flash 40 emits a substantial amount of energy in the form of intense light, sound, pressure waves and shock waves. It further causes vaporization of electrodes resulting in high pressure. (Such arcing fault facilitates diverting energy away from the arc flash 36). It may be noted that the arc electrode system 20, by virtue of its functionality, includes an enclosure or arc containment device 22 robust enough to contain shock waves and high pressure resulting from arc flash 40. The construction and functionality of the arc containment device 22 is discussed in detail below.

In one embodiment of the invention, the arc containment device may be a vented arc containment device as described in FIGS. 2, 3, 4 and 5. In another embodiment of the invention, the arc containment device may be a non-vent arc containment device (FIG. 6). Typically, the non-vent arc containment devices occupy more volume. For example, in a 600 volt system, for a 65 kA/5 cycles arc flash energy, the non-vent arc containment device may occupy about 0.1 meter cube in volume, while the vented arc containment device may occupy about less than 0.01 meter cube in volume, for same arc flash energy level. However, it may be noted that appropriate arc containment device (vented or non-vented) may be used depending on requirement of location of installation.

Figure 2:
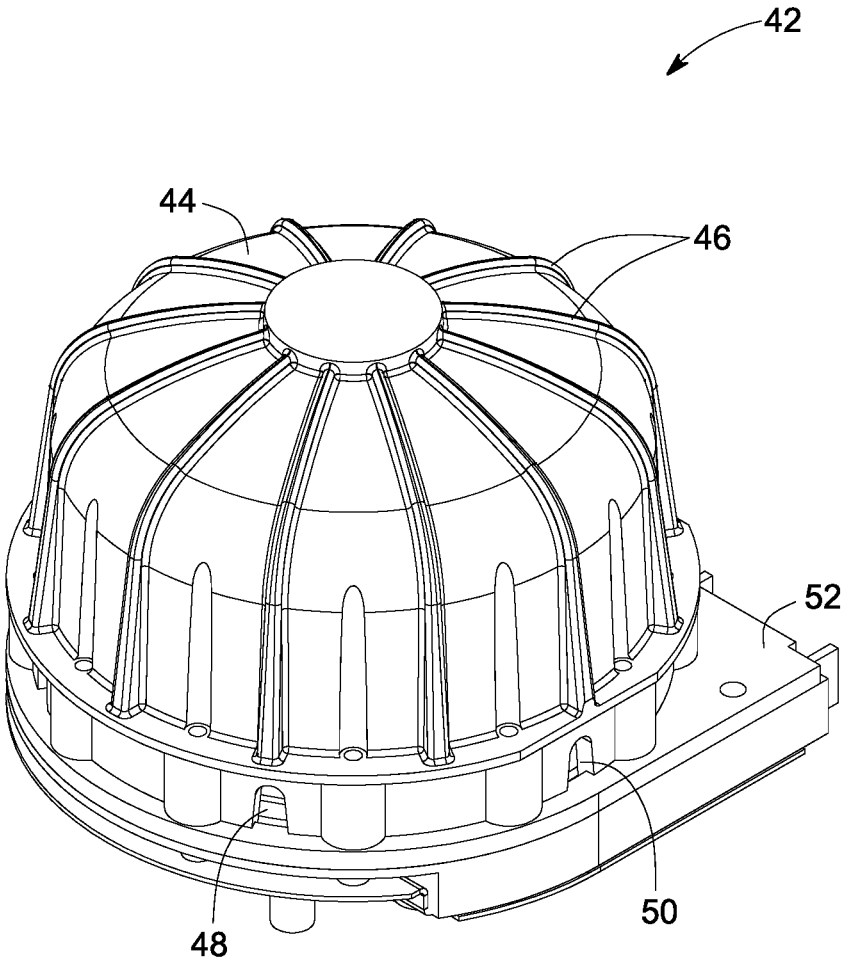
FIG. 2 is a diagrammatic representation of an arc containment device.

FIG. 2 illustrates an exemplary arc containment device 42 implemented according to an aspect of the present technique. It may be noted that the arc containment device 42 may be implemented as the arc containment device 22 for the arc electrode system 20, as referenced in FIG. 1. In the illustrated embodiment the arc containment device 42 includes an outer enclosure 44. The outer enclosure may be made of any suitable material, such as metal, non-conducting material, composites and so forth. Ribs 46 are provided around the outer enclosure surface to improve its mechanical strength (particularly its ability to resist high internal pressures resulting from arc flash within the device). Vents 48 and 50 are provided at bottom sides of the outer enclosure 44. However, it may be noted that in the illustrated exemplary embodiment, a single such vent extends around substantially the entire lower periphery of the outer enclosure. The outer enclosure is fixed to a support assembly 52. The support assembly 52 includes an electrical insulation base (not visible in FIG. 2) that will be positioned within the enclosure when the device is assembled as shown.

Figure 3:
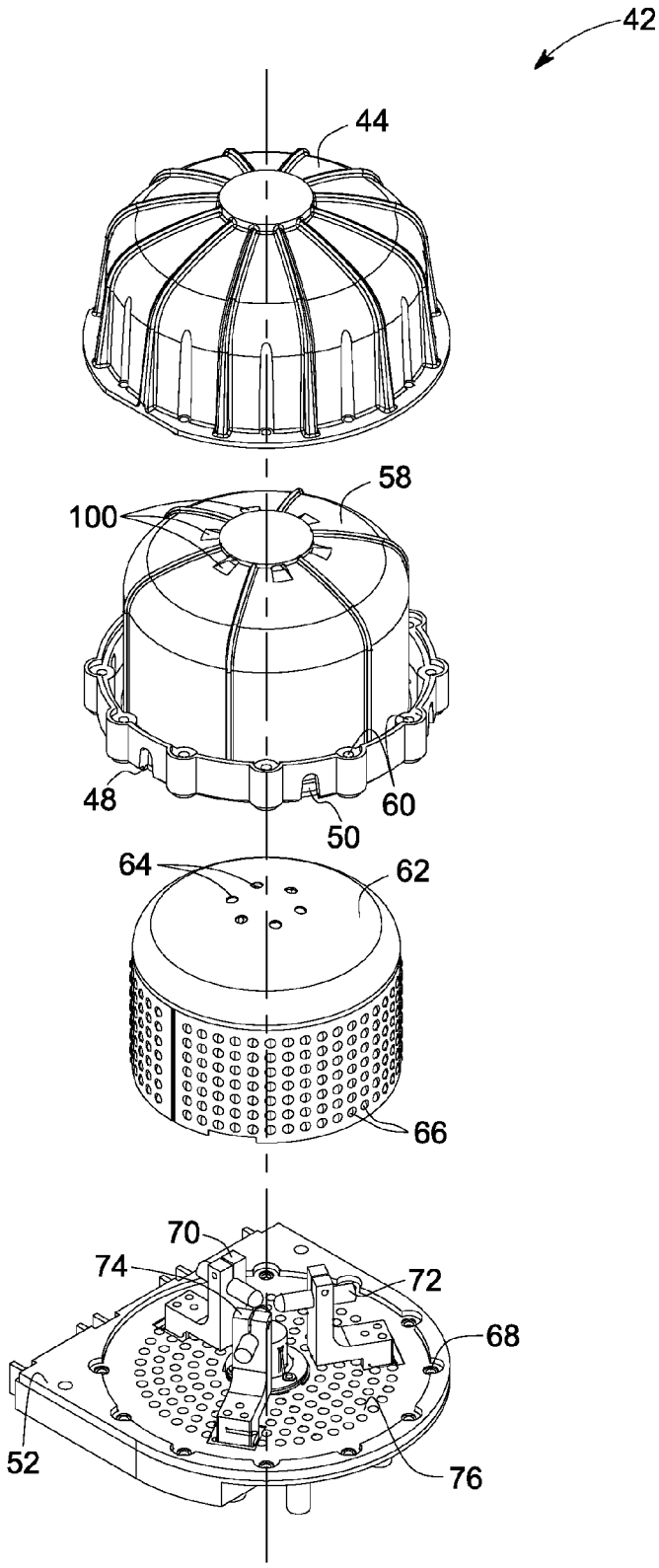
FIG. 3 is an exploded view of an arc containment device illustrating certain exemplary component parts and an arc source.

FIG. 3 illustrates an exploded view of the exemplary arc containment device 42 of FIG. 2. According to the illustrated embodiment, arc containment device 42 comprises various components such as the outer enclosure 44, an inner enclosure 58, a shock shield 62 and support assembly 52 as depicted in FIG. 3. In a particular embodiment, the shock shield includes an electrically conducting material or electrically non-conducting material. In one embodiment of the invention, the inner enclosure includes an electrically conducting material or an electrically non-conducting material In a presently contemplated embodiment, the outer enclosure 44 is fastened on to the inner enclosure 58 via bolts (not shown) running through holes such as indicated by reference numeral 60. The bolts are received through generally aligned holes in the outer enclosure 44, the inner enclosure 58 and the support assembly 52. The components are thus properly located and solidly held together to resist shock waves and high pressures resulting from arc flash events within the arc containment device. The outer enclosure is disposed around the inner enclosure 58. The shock shield 62 is disposed within the inner enclosure 58. In a presently contemplated embodiment, the shock shield 62 comprises corrugations 66 around its periphery. Corrugations 66 help in absorbing the shock waves by way of diffusion and flexing. As will be appreciated by those skilled in the art, by using a shock shield 62, the volumetric construction of the arc containment device 42 may be substantially reduced, as compared to a device without a shock shield to absorb similar magnitudes of shock waves and high pressure. On the top surface of the shock shield 62, apertures 64 are provided that are generally aligned with the openings 100 on the inner enclosure 58 for escape of gas that results from heating by the arc flash 40 as referenced in FIG. 1. The outer enclosure and the inner enclosure are fastened on to the support assembly 52. The support assembly 52 includes hole 68 aligned with the holes 60 to accommodate fasteners. Electrodes 70, 72 and 74 are mounted onto the support assembly 52 forming an arc source. Electrical contact rods (not shown) are provided that extend through the support assembly to facilitate connection of the electrodes to the power source (e.g., to the power bus). The support assembly 52 may be made of any suitable electrically insulating material and composites to provide an electrical insulation base 76 for the electrodes.

Figure 4:
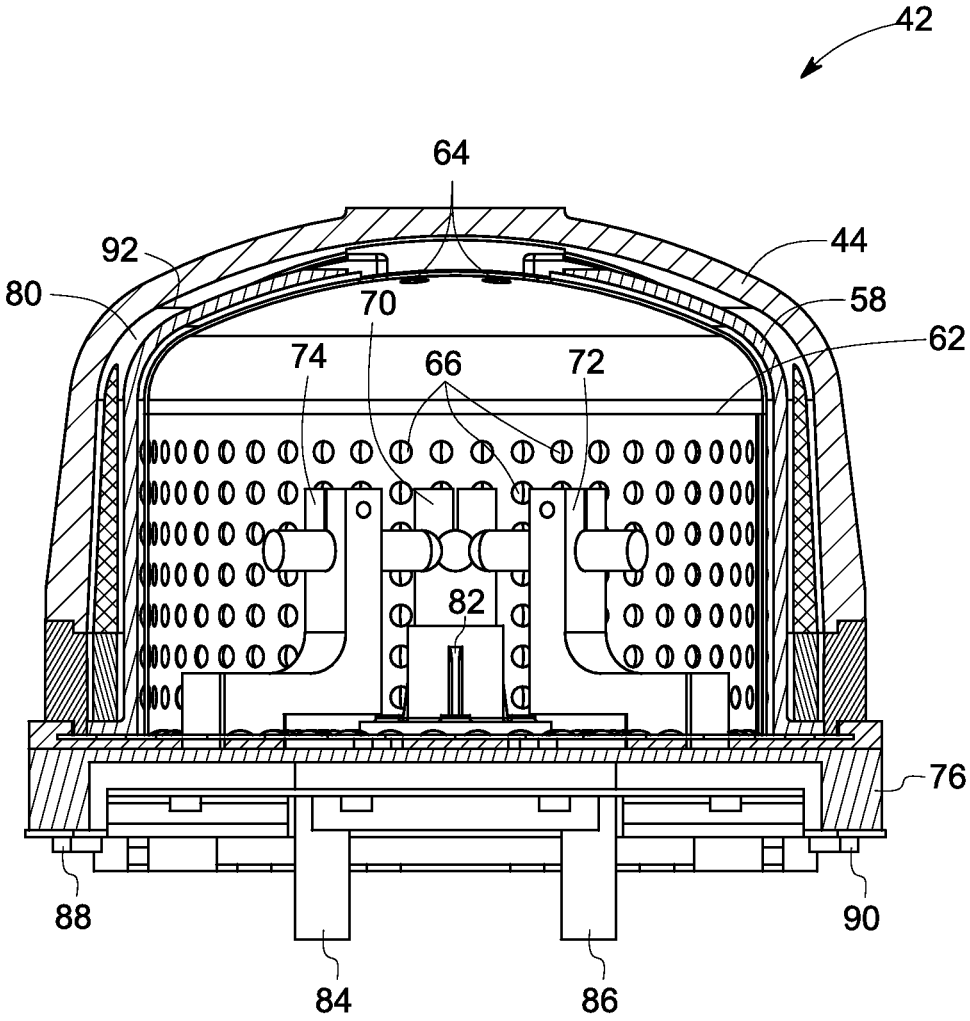
FIG. 4 is a partial sectional view of the arc containment device of FIG. 3.

FIG. 4 is a cross sectional assembled view of the exemplary arc containment device 42. As mentioned above, the construction of the arc containment device 42 is made rigid to withstand high pressure and shock waves from arc flash events. The inner enclosure 58 is housed on an electrical insulation base 76. It may be noted that the electrical insulation base 76 is part of the support assembly 52 as referenced in FIG. 3. A shock shield 62 is disposed around the electrodes. The shock shield 62 is configured to absorb shock waves generated in the event of an arc flash by way of the corrugations 66 on the surface on the shock shield 62. The inner enclosure 58 is disposed around the shock shield 62. Apertures 64 are provided on the shock shield 62 and openings on the inner enclosure 58 are provided for passage of gas. The outer enclosure 44 is disposed around the inner enclosure 58 to facilitate a passageway 80 between the inner enclosure 58 and the outer enclosure 44 for escape of gas. A plasma gun 82 is placed at the center of electrodes 70, 72 and 74 that are fixed to the electrical insulation base 76. In one embodiment, the plasma gun 82 injects plasma as an arc mitigation technique, to create an arcing fault in response to the arc fault signal 38, as referenced in FIG. 1. The electrodes are connected to the external circuitry via electrical contacts 84 and 86 and a third electrical contact (not shown). The outer enclosure 44 and the inner enclosure 58 are fastened to the electrical insulation base 76 via fasteners 88 and 90. De-ionizing plates 92 are disposed in the passageway 80 to de-ionize the gas prior to expulsion from the arc containment device 42.

Figure 5:
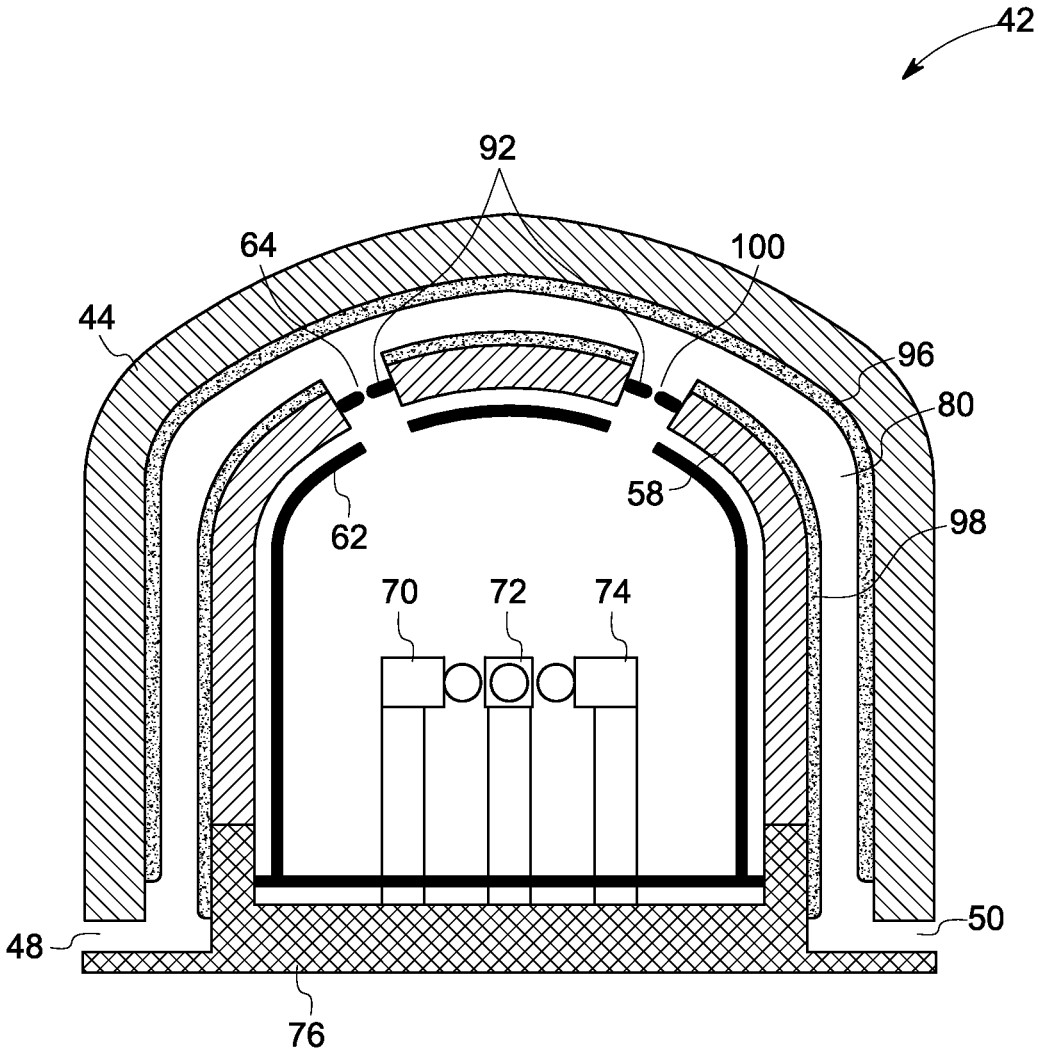
FIG. 5 is a cross sectional view of the arc containment device illustrating vents for channeling gas.
Figure 6:
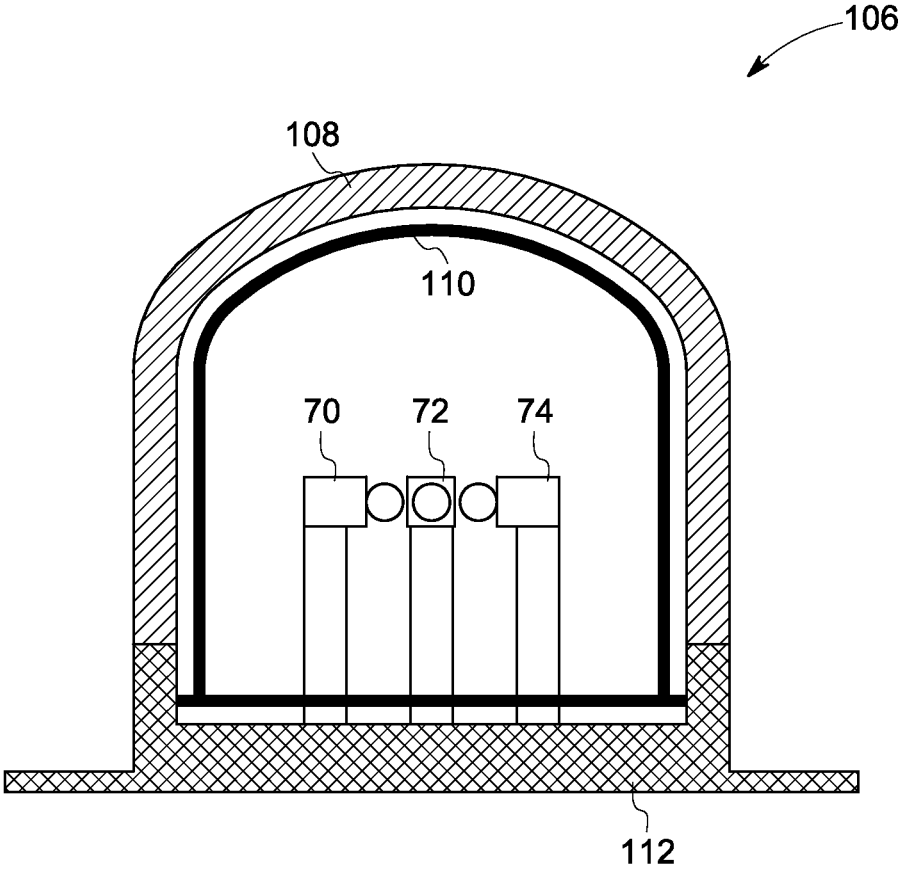
FIG. 6 is a cross sectional view of a non-vented arc containment device according to an embodiment of the invention.

FIG. 5 is a partial sectional view of the arc containment device 42. The construction of the device 42 includes an outer enclosure 44 disposed around an inner enclosure 58 to provide a passageway 80 between the inner enclosure 58 and the outer enclosure 44. An ablative layer 96 is disposed on the inner surface of the outer enclosure 44. A second ablative layer 98 is disposed on the outer surface of the inner enclosure 58. In an exemplary embodiment, the ablative layer comprises an ablative polymer such as but not limited to Delrin, Teflon or Polypropylene. Various methods of disposing the ablative layers 96 and 98 such as spraying, fixing a sheet, and so forth may be incorporated. The passageway 80 has vents 48 and 50 at the bottom to expel gas out of the device 42. The ablative layers 96 and 98 absorb heat generated by gas in the event of arc flash 40, as referenced in FIG. 1, in the passageway 80 via ablation. A shock shield 62 is disposed within the inner enclosure 58. The electrodes 70, 72 and 74 are housed on an electrical insulation base 76. The shock shield has apertures 64 aligned to the openings 100 on the inner enclosure 58. Two such apertures 64 and openings 100 are shown here by way of example. Many such apertures 64 and respective openings 100 may be disposed respectively on the shock shield 62 and the inner enclosure 58. As will be appreciated by one skilled in the art, the apertures 64 and openings 100 are aligned for passage of gas. De-ionizing plates 92 are disposed adjacent to the apertures 64.

FIG. 6 illustrates a perspective view of a non-vent arc containment device 106. The device 106 includes an enclosure 108, a shock shield 110, an electrical insulation base 112 and electrodes 70, 72 and 74. In the illustrated embodiment, the electrodes forming an arc source are enclosed within non-vent arc containment device 106. In the event of an arc flash 40 as referenced in FIG. 1, the shock shield 110 is configured to absorb shock waves released by the arc flash. The shock shield 110 includes corrugation around its surface that provides flexing during absorption of shock waves. It may be noted that corrugation provides diffusion of the shock wave by way of providing more surface area of exposure to the shock wave. The enclosure 108 is disposed around the shock shield 110 and fixed on to the electrical insulation base 112. The electrical insulation base 112 provides support for the electrodes 70, 72 and 74.

Advantageously, such arc containment devices reduce high pressure within the device enabling lower operating pressure. Also the device diffuses shock waves thereby facilitating compact construction. Hence, simplified construction design and compact size of the arc containment device are achieved in accordance with the disclosed techniques.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A device for diverting energy away from an arc flash occurring within an electrical power system, the electrical power system having a common bus having a plurality of phase conductors, an arc flash decision system, and a sensor, the arc flash when present being in electrical communication between at least two of the plurality of phase conductors of the common bus, the arc flash decision system being disposed in signal communication with the device for diverting energy, the arc flash decision system being configured to generate an arc fault signal in an event of the arc flash occurring within the electrical power system, the device comprising:

an arc source configured to create a second arc flash;

a plasma gun configured and disposed to inject plasma in proximity of the arc source in response to the arc flash within the electrical power system;

a shield configured and disposed to house the arc source and the plasma gun; and a first enclosure configured and disposed to house the shield;

wherein the arc source comprises an arc electrode system comprising a plurality of electrodes and a plurality of conductors disposed in electrical communication with the plurality of electrodes, each of the plurality of conductors of the arc source having electrical contacts configured and disposed to connect to respective ones of the plurality of phase conductors of the electrical power system.

2. The device of claim 1, wherein:

the shield comprises an aperture, and the first enclosure comprises an opening, the aperture and the opening being disposed relative to each other to permit gas flow from a region inside the shield to a region outside the first enclosure.

3. The device of claim 2, further comprising:

a second enclosure configured and disposed to house the first enclosure.

4. The device of claim 1, wherein the shield comprises a plurality of corrugations.

5. The device of claim 3, wherein:

the first enclosure and the second enclosure are spaced apart to form a passageway therebetween, the passageway being disposed in fluid communication with a vent to permit gas flow from the second arc flash to flow from a region inside the passageway to a region outside the second enclosure.

6. The device of claim 3, wherein:

at least one of the shield, the first enclosure, and the second enclosure, comprises an electrically non-conducting material; and further comprising:

an electrically non-conductive base configured and disposed to support the arc source and the plasma gun.

7. The device of claim 3, further comprising:

an electrically non-conductive base;

wherein at least one of the shield, the first enclosure, and the second enclosure, is supported by the base.

8. The device of claim 5, wherein:

at least one of the shield, the first enclosure, and the second enclosure, comprises a shape capable of withstanding a pressure internal of the shield that is greater than a pressure external of the second enclosure, the pressure internal of the shield resulting from the second arc flash.

9. The device of claim 8, wherein:

the shape comprises a dome shape.

10. The device of claim 5, wherein the vent is disposed in a side of the second enclosure.

11. The device of claim 7, wherein the plurality of conductors are fastened to the base in electrical communication with the plurality of electrodes.

12. The device of claim 2, wherein the aperture of the shield is aligned with the opening of the first enclosure.

13. The device of claim 2, further comprising a de-ionizing plate disposed in fluid communication with the aperture of the shield.

14. The device of claim 2, further comprising a de-ionizing plate disposed adjacent the aperture of the shield.

15. A device for diverting energy away from an arc flash occurring within an electrical power system, the device comprising:

an arc source configured to create a second arc flash;

a plasma gun configured and disposed to inject plasma in proximity of the arc source in response to the arc flash within the electrical power system;

a shield configured and disposed to house the arc source and the plasma gun;

a first enclosure configured and disposed to house the shield;

a second enclosure configured and disposed to house the first enclosure;

a first ablative layer disposed proximate an outer surface of the first enclosure; and a second ablative layer disposed proximate an inner surface of the second enclosure;

wherein the shield comprises an aperture, and the first enclosure comprises an opening, the aperture and the opening being disposed relative to each other to permit gas flow from a region inside the shield to a region outside the first enclosure;

wherein the first enclosure and the second enclosure are spaced apart to form a passageway therebetween, the passageway being disposed in fluid communication with a vent to permit gas flow from a region inside the passageway to a region outside the second enclosure;

wherein the passageway is disposed between the first and the second ablative layers.

16. A method of manufacturing a device configured for diverting energy away from an arc flash occurring within an electrical power system, the electrical power system having a common bus having a plurality of phase conductors, an arc flash decision system, and a sensor, the arc flash when present being in electrical communication between at least two of the plurality of phase conductors of the common bus, the arc flash decision system being disposed in signal communication with the device configured for diverting energy, the arc flash decision system being configured to generate an arc fault signal in an event of the arc flash occurring within the electrical power system, the method comprising:

providing an arc source comprising an electrode system comprising a plurality of electrodes, each of the plurality of conductors of the arc source having electrical contacts configured and disposed to connect to respective ones of the plurality of phase conductors of the electrical power system;

providing a plasma gun configured an disposed to inject plasma in proximity of the arc source in response to the arc fault signal in an event of the arc flash occurring within the electrical power system;

disposing a shield over the arc source and the plasma gun such that the arc source and the plasma gun are contained within the shield;

disposing a first enclosure over the shield such that the shield is contained within the first enclosure;

disposing a second enclosure over the first enclosure such that the first enclosure is contained with the second enclosure; and securely fastening the arc source and the first enclosure to the second enclosure.

17. The method of claim 16, wherein the shield comprises a plurality of apertures and the first enclosure comprises a plurality of openings, and further wherein:

the disposing the first enclosure over the shield comprises disposing the plurality of openings in alignment with the plurality of apertures; and the disposing the second enclosure over the first enclosure comprises forming a passageway between the second enclosure and the first enclosure.

18. The method of claim 17, further comprising:

disposing a plurality of de-ionizing plates adjacent the plurality of apertures of the shield.

19. The method of claim 17, further comprising:

disposing an ablative material in the passageway.

20. The method of claim 17, wherein the securely fastening the arc source and the first enclosure to the second enclosure further comprises:

positioning a plurality of vents in the second enclosure such that the passageway is disposed in fluid communication with the plurality of vents.

21. A method of manufacturing a device, comprising:

disposing a shield over an arc source such that the arc source is contained within the shield;

disposing a first enclosure over the shield such that the shield is contained within the first enclosure;

disposing a second enclosure over the first enclosure such that the first enclosure is contained with the second enclosure;

securely fastening the arc source and the first enclosure to the second enclosure;

wherein the shield comprises a plurality of apertures and the first enclosure comprises a plurality of openings;

wherein the disposing the first enclosure over the shield comprises disposing the plurality of openings in alignment with the plurality of apertures;

wherein the disposing the second enclosure over the first enclosure comprises forming a passageway between the second enclosure and the first enclosure, and further comprising disposing an ablative material in the passageway;

wherein the disposing an ablative material in the passageway comprises:

disposing a first layer of ablative material on an outer surface of the first enclosure; and disposing a second layer of ablative material on an inner surface of the second enclosure.

* * * * *

UNITED STATES PATENT AND TRADEMARK OFFICE

CERTIFICATE OF CORRECTION

PATENT NO. : 8,563,888 B2
APPLICATION NO. : 12/137460
DATED : October 22, 2013
INVENTOR(S) : Bohori et al.

It is certified that error appears in the above-identified patent and that said Letters Patent is hereby corrected as shown below:

In the Specification

In Column 3, Line 63, delete "material" and insert -- material. --, therefor.

In the Claims

In Column 5, Line 59, in Claim 1, delete "response to the arc flash" and insert -- response to the arc fault signal in an event of the arc flash occurring --, therefor.

Signed and Sealed this
Fourth Day of February, 2014

Michelle K. Lee

Michelle K. Lee
*Deputy Director of the United States Patent and Trademark Office*